US005735498A

United States Patent [19]

Jue et al.

[11] Patent Number: 5,735,498

[45] Date of Patent: Apr. 7, 1998

[54] APPARATUS FOR MOUNTING AN EMERGENCY SIGN TO A SUPPORT

[75] Inventors: George Hall Jue, Hoffman Estates; Gregory Louis Kuffel, Schaumburg, both of Ill.

[73] Assignee: Cooper Industries, Inc., Houston, Tex.

[21] Appl. No.: 647,452

[22] Filed: May 7, 1996

[51] Int. Cl.[6] ..... A47K 1/00

[52] U.S. Cl. ..... 248/222.12

[58] Field of Search ..... 248/222.12, 222.11, 248/221.13, 224.51, 222.41, 221.12; 411/133, 134, 533; 362/404, 147, 812, 368; 40/570, 564, 606

[56] References Cited

U.S. PATENT DOCUMENTS

| | | | |
|---|---|---|---|
| 2,578,008 | 12/1951 | Judd | 411/133 X |
| 5,102,275 | 4/1992 | Hulsey | 411/533 X |
| 5,138,116 | 8/1992 | Kabayama | 248/222.12 X |
| 5,207,535 | 5/1993 | Saab | 411/533 X |
| 5,267,404 | 12/1993 | Kizy | 40/564 X |
| 5,272,605 | 12/1993 | Johnstone | 248/906 X |
| 5,376,020 | 12/1994 | Jones | 362/147 X |
| 5,526,251 | 6/1996 | Andre et al. | 40/570 X |

*Primary Examiner*—Ramon O. Ramirez

*Attorney, Agent, or Firm*—Burne, Doane, Swecker & Mathis LLP

[57] ABSTRACT

An emergency sign is mounted to a canopy that is attached to a support such as a ceiling or vertical wall. The canopy includes a post, and the sign includes a housing having a slot for receiving the post. The slot includes a wide portion and a narrow portion. The post is insertable into the wide portion and then slidable into the narrow portion. The sign housing includes a pair of locking arms that are spread apart by movement of the post into the narrow portion, and then snap back to a position blocking reverse travel of the post out of the narrow portion. The canopy includes through-holes for receiving mounting screws to secure the canopy to a support. Each through-hole includes radially inwardly projecting ears which are deformable in response to the entry of a screw into the through-hole to retain the screw in the through-hole during the mounting procedure.

6 Claims, 2 Drawing Sheets

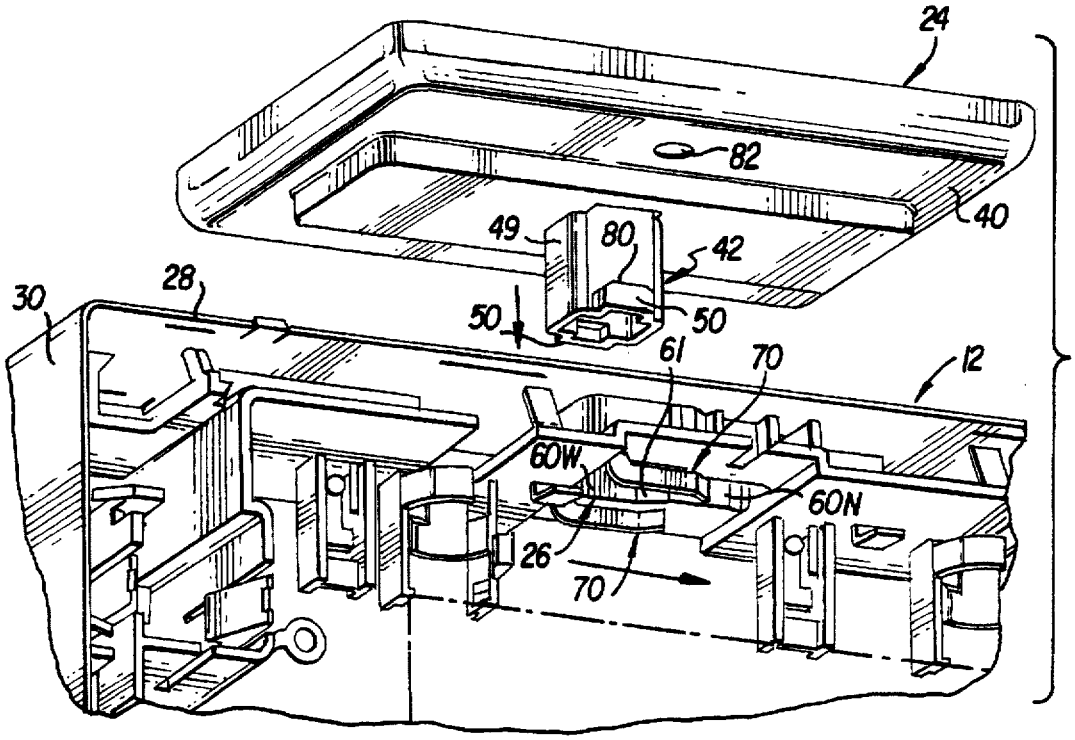
FIG. 2
FIG. 3
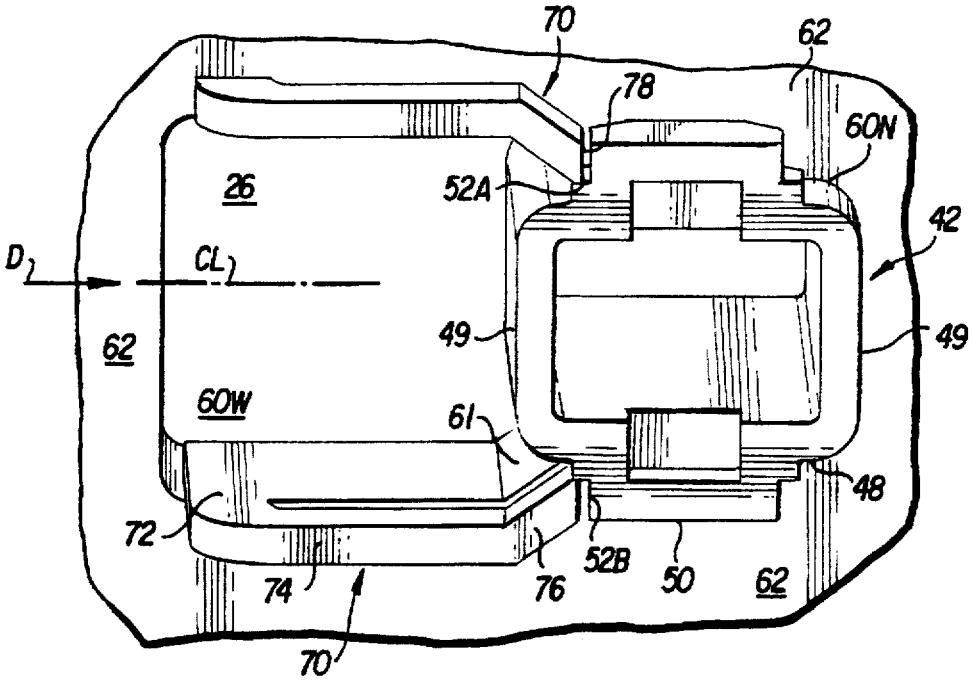

APPARATUS FOR MOUNTING AN EMERGENCY SIGN TO A SUPPORT

BACKGROUND OF THE INVENTION

The present invention relates to illuminatable signs, such as emergency exit signs, and in particular to a mounting structure therefor.

For safety reasons, buildings such as offices and apartments provide illuminated exit signs which indicate the location of the building exits. Thus, in an emergency such as a fire, persons within the building can exit the building more quickly. Such a sign typically comprises a housing which can be hung on a ceiling or wall, and which forms an inner chamber that houses an illumination source (e.g., a bulb or LED units). Covering the front and rear sides of the chamber are main plates, one or both of which is a stencil having through-holes therein shaped to form certain indicia (e.g., "exit"), as well as to form an arrow pointing to the left or right. A diffuser plate is interposed between the stencil and the illumination source to diffuse light of a suitable color (e.g., red) toward the through-holes.

Mounting of the sign to a ceiling or wall is typically accomplished by anchoring a support member, often referred to as a canopy, to the ceiling or wall, and then attaching the sign housing to the support member. It is necessary that the sign be mounted without risk of dislodgement, but it is also desirable to simplify the mounting procedure.

It will be appreciated that the practice of securing the sign housing to the canopy by screws assures that the sign is reliably secured, but it is difficult for an installer, working alone, to hold the sign in place while holding a screw and maneuvering a screw driver.

Snap-in type connectors for sign housings have been proposed, e.g., see U.S. Pat. No. 5,272,605, wherein the canopy includes a downwardly projecting post having a pair of spring fingers. The housing includes an aperture which receives the post as the housing is pushed upwardly toward the post. In so doing, the spring fingers are initially elastically depressed and then snap back out so that the weight of the housing is supported by upwardly facing shoulders of the spring fingers. A shortcoming of such a connection involves the risk of the sign housing becoming uncoupled upon sufficient flexing of the spring fingers. That risk can be reduced by making the shoulders relatively wide, but then the fingers must be made more flexible in order to enable them to flex sufficiently to allow the housing to pass over the shoulders. By making the fingers more flexible, however, the benefit of widening the shoulders is diminished.

It would be desirable, therefore, to provide a mounting apparatus for a sign, such as an emergency exit sign, which provides for simple installation as well as a reliable securement of the housing and which does not rely upon spring fingers to bear the weight of the housing.

SUMMARY OF THE INVENTION

One aspect of the invention relates to the combination of a canopy attachable to a support structure, and a sign housing attachable to the canopy. The housing includes a slot having a wide portion and a narrow portion. The wide and narrow portions are aligned relative to a center line of the slot. The canopy includes a post having a free end on which a pair of projections project laterally outwardly. The post is configured to be insertable into the wide portion of the slot in a direction parallel to the post, and slid along the center line of the slot into the narrow portion thereof wherein the projections secure the post against removal from the slot in a direction parallel to the post. The housing further includes a pair of elastically flexible locking arms having free ends arranged to be cammed away from one another by the post as the post enters the narrow portion of the slot, and to snap back to a position behind the post after the post enters the narrow portion, to prevent return travel of the post into the wide portion of the slot.

In another aspect of the invention, the sign canopy is adapted to be secured by screws to the support and includes a base and a carrier for carrying a sign housing. The base include through-holes for receiving respective screws. Each through-hole includes a plurality of radially inwardly project screw retaining ears for being deformed by a thread of a mounting screw to oppose reverse travel of the screw out of the through-hole before the screws are inserted into a support. Preferably, the ears are deformable into a discontinuous helical configuration by the screw thread.

BRIEF DESCRIPTION OF THE DRAWINGS

The objects and advantages of the invention will become apparent from the following detailed description of preferred embodiments thereof in connection with the accompanying drawing in which like numerals designate like elements and in which:

FIG. 2 is an exploded perspective view of a mounting canopy and an upper portion of a sign housing, with a side panel of the housing removed to expose the underside of a top wall of the housing;

FIG. 3 is a bottom perspective view of a top wall of the housing, with a post of the canopy mounted in a locked position within a slot of the top wall;

DETAILED DESCRIPTION OF PREFERRED EMBODIMENTS OF THE INVENTION

Figure 1:
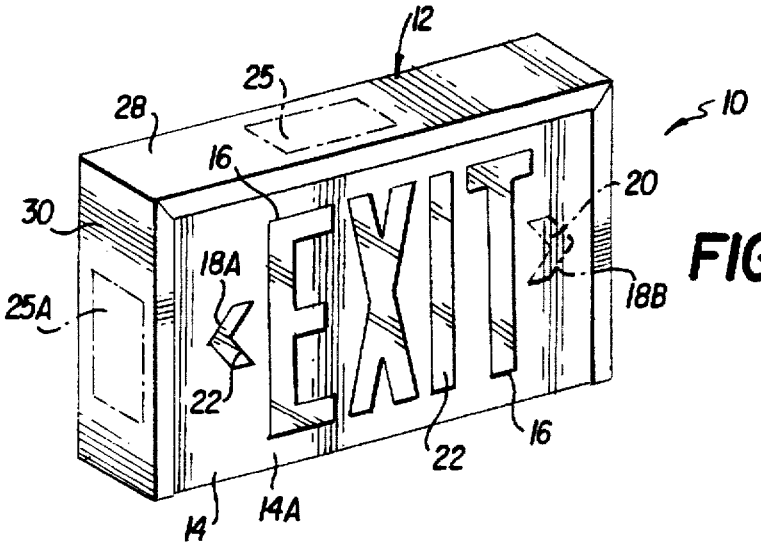
FIG. 1 is a top front perspective view of an emergency exit sign according to the present invention.

Depicted in FIG. 1 is an exit sign 10 comprising a housing 12 (e.g., formed of plastic or metal) that forms an internal chamber capable of being illuminated by a light source (not shown), such as a lamp or LED units in a conventional fashion. Extending across front and rear sides of the chamber are plates or panels 14 (only one shown in FIG. 1). One or both of those panels comprises a stencil having through-holes 16, 18A, 18B for accommodating the passage of light. The through-holes 16 form the word "Exit", whereas the through-holes 18A, 18B are generally arrow shaped (e.g., chevron-shaped in the preferred embodiment). The arrow 18A points to the left, whereas the arrow 18B points to the right in FIG. 1. Depending upon the location of the exit relative to the exit sign, one, or both, or neither of the arrows 18A, 18B may be illuminated.

Disposed behind the stencil 14 is a light diffusing sheet of material 22 which diffuses light of a suitable color (e.g., red) toward the through-holes in the stencil.

The housing 12 is mounted to a ceiling or a wall by a snap-in connection formed by a canopy 24 and a slot structure of the housing 12. The housing 12 preferably has a pair of slots 26 in a top 28 and a side 30 of the housing, respectively, to enable the housing to be optionally mounted to a ceiling structure or a vertical wall structure. The slots 26 are identical and covered by punch-out plates 25, 25A formed by perforations formed in the housing.

The canopy 24 includes a base 40 and a post 42 projecting outwardly from the base 40. The base is secured to the ceiling or wall by screws.

The post 42 is of non-circular cross sectional shape, preferably rectangular, and is formed by two pairs of opposite and parallel sides 48, 49. The sides 48, 49 are of identical construction and each includes an outward projection 50 at its outer end. Each projection 50 includes first and second faces 52, 54 having a stepped configuration (see FIG. 4). That is, the face 52 includes a portion 52A facing in a direction parallel to its respective side 48, and a portion 52B facing in a direction perpendicular to the respective side 48. Likewise, the face 54 has portions 54A, 54B facing parallel and perpendicular, respectively, relative to the side 48.

Figure 4:
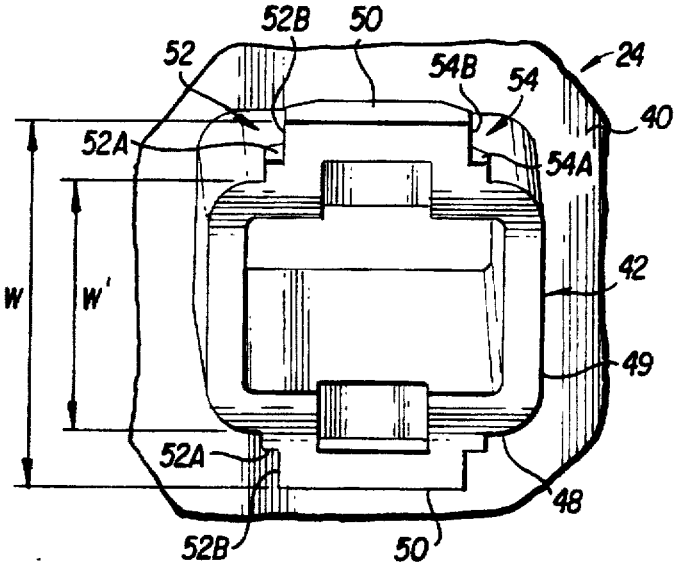
FIG. 4 is a bottom perspective view of the post.

The slots 26 formed in the walls 28 and 30 are of identical configuration, so only the slot formed in the top wall 28 will be explained in detail. The slot 26 has wide and narrow portions 60W, 60N interconnected by inclined walls 61 (see FIG. 2). The wide portion 60W is slightly larger than the width W of the outer end of the post 42 (i.e., the end including the projections 50 as shown in FIG. 4) to enable the free end of the post to pass completely therethrough. The narrow portion 60N has a width which is slightly larger than the width W' of the sides 49 of the post, i.e., the portion of the post excluding the projections 50.

Thus, once the post 42 has been passed through the wide portion 60W in a direction parallel to the post and then slid in direction D along the centerline CL of the slot, the projections 50 come to a position disposed behind (below) an inner (bottom) surface 62 of the wall 28. Hence, the post 42 cannot become separated from the housing 12 in a direction parallel to the post 42 (i.e., a vertical direction in FIG. 2).

The housing 12 further includes a pair of cantilever-type locking arms 70 preferably formed of one piece with the wall 28, e.g., of plastic (see FIG. 3). Each locking arm 70 includes a base portion 72 formed of one piece with the surface 62 and extending perpendicular thereto, an intermediate portion 74 extending along the wide portion 60W of the slot 60 parallel to the center line CL of the slot, and an end portion 76 inclined inwardly toward the slot axis and extending generally parallel to the respective inclined wall 61 of the slot.

The end portion 76 terminates in a flat stop surface 78 lying in a plane oriented perpendicular to the center line CL.

To install the sign housing 12 to a ceiling-mounted canopy 24, the punch-out plate 25 is manually punched out of the top wall 28. Then, the housing is pushed upwardly toward the canopy to cause the post 42 to pass downwardly through the wide portion 60W of the slot 26. Then, the housing is shifted forwardly in a horizontal direction D perpendicular to the post 42, toward the inclined portions 76 of the locking arms, which are currently in a relaxed state. When the post engages the inclined end portions 76 of the locking arms 70 it cams those end portions 76 away from one another. Once the post 42 has passed the locking arms 70, the locking arms 70 snap back toward one another to a position where the stop surfaces 78 are blocking movement of the post backwardly along the center line. Hence, the housing 12 becomes securely attached to the post 42.

When the locking arms 70 snap back to their locking positions, they are prevented from returning completely to their respective relaxed states due to their engagement with the surface portions 52A of the post. This ensures that the locking arms will remain spring-biased toward one another, the spring bias providing an initial resistance that must be overcome before the locking arms can be spread apart sufficiently to enable the post to be removed from the slot. This provides additional security against unintentional release of the housing from the canopy. Also, the housing tightly grips the post to oppose vibration.

The securement of the housing is further ensured since the weight of the housing is transmitted and borne by rigid structures, namely, the top surfaces 80 of the projections 50, and the top wall 28 of the housing. That provides a greater degree of integrity than would be the case if the weight of the housing were transmitted or borne by flexible elements such as spring fingers.

To release the housing, it is necessary to spread the locking arms 70 apart, but that requires that access to the interior of the housing be gained. Thus, release by accident or unauthorized tampering is even less likely to occur.

It will be appreciated that the housing could, instead, be mounted to a vertical wall. In that case, the post would extend horizontally, requiring that the housing be pushed toward the post in a horizontal direction to cause the post to enter the wide portion of the slot. Then, the housing is shifted downwardly to cause the post to enter the narrow portion of the slot. The weight of the housing will then be borne by a top (i.e. downwardly facing) wall of the slot.

Figure 5:
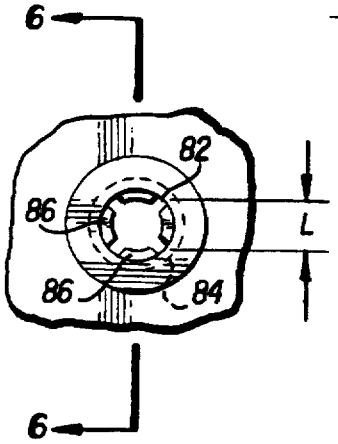
FIG. 5 is a view of a through-hole formed in the canopy taken in the direction of line 5—5 in FIG. 6.
Figure 6:
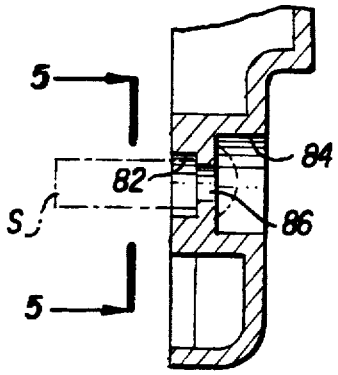
FIG. 6 is a sectional view taken along the line 6—6 in FIG. 5.

Another feature of the invention relates to the ability of the canopy to retain the mounting screws prior to the attachment of the screws to the support structure. In that regard, the base 40 of the canopy 24 includes at least two through-holes 82 for receiving screws S (see FIGS. 2, 5, 6). Each through-hole 82 is counterbored at one end 84, and a plurality of circumferentially spaced ears 86 project radially inwardly from an inner periphery of the through-hole 82 (see FIG. 5). The ears 86 define an inner diameter L smaller than the maximum thread diameter of a mounting screw S. The ears are formed of a deformable material, e.g., plastic in the case of a plastic molded canopy. Thus, when the end of a mounting screw is pushed against the ears (i.e., pushed from right-to-left in FIG. 6) and rotated, the screw thread engages the ears and deforms the ears into a generally helical pattern (i.e., the ears together define a discontinuous (interrupted) helix), and thus, in effect, forming a short internal screw thread which allows the screw to pass through and become threadedly attached to the ears. Hence, the screw is retained in the canopy. Accordingly, once an installer pushes the screws into the through-holes, the canopy can be placed against the support, e.g., wall or ceiling, without concern that the screws will fall out. This facilitates a two-handed mounting procedure, i.e., one hand to hold the canopy against the support, and another hand to operate a screwdriver.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. In combination, a canopy attachable to a support structure, and a sign housing attachable to the canopy:

the housing including a slot having a wide portion and a narrow portion, the wide and narrow portions being aligned relative to a centerline of the slot;

the canopy including a post having a free end on which a pair of projections project laterally outwardly, the post configured to be insertable into the wide portion of the slot in a direction parallel to the post and slid along the centerline of the slot into the narrow portion thereof wherein the projections secure the post against removal from the slot in a direction parallel to the post;

the housing further including a pair of elastically flexible locking arms having free ends arranged to be cammed away from one another by the post as the post enters the narrow portion of the slot, and to snap back to a position behind the post after the post enters the narrow portion, to prevent return travel of the post into the wide portion of the slot.

2. The combination according to claim 1 wherein the locking arms extend along respective side edges of the slot generally parallel to the centerline of the slot.

3. The combination according to claim 2 wherein the locking arms are of one piece construction with a wall of the housing, each locking arm being anchored at one end and extending therefrom in cantilever fashion along a respective side edge of the wide portion of the slot.

4. The combination according to claim 3 wherein each of the locking arms is biased to a relaxed state, the post including surfaces preventing the locking arms from returning completely to their relaxed states when the post is disposed in the narrow portion of the slot.

5. The combination according to claim 1 wherein each of the locking arms is biased to a relaxed state, the post including surfaces preventing the locking arms from returning completely to their relaxed states when the post is disposed in the narrow portion of the slot.

6. The combination according to claim 1 wherein the base of the canopy includes through-holes for receiving respective mounting screws, each screw hole including a plurality of radially inwardly projecting screw-retaining ears for being deformed by a thread of a mounting screw to oppose reverse travel of the screw out of the through-hole before the mounting screw is attached to a support.

* * * * *